US006372116B1

(12) United States Patent
Kim et al.

(10) Patent No.: US 6,372,116 B1
(45) Date of Patent: Apr. 16, 2002

(54) METHOD OF FORMING A CONDUCTIVE LAYER AND AN ELECTROPLATING APPARATUS THEREOF

(75) Inventors: Do-Heyoung Kim; Jae-Jeong Kim, both of Seoul; Jae-Hee Ha, Chungcheongbuk-do, all of (KR)

(73) Assignee: Hyundai Microelectronics Co., Ltd, Chungcheongbuk-do (KR)

( * ) Notice: Subject to any disclaimer, the term of this patent is extended or adjusted under 35 U.S.C. 154(b) by 0 days.

(21) Appl. No.: 09/396,202

(22) Filed: Sep. 15, 1999

(30) Foreign Application Priority Data

Nov. 14, 1998 (KR) ..... 98-48887

(51) Int. Cl.[7] ..... C25D 5/34
(52) U.S. Cl. ..... 205/205
(58) Field of Search ..... 205/148, 205

(56) References Cited

U.S. PATENT DOCUMENTS 3,351,539 A * 11/1967 Branson ..... 204/14
3,427,231 A * 2/1969 Schneider et al. ..... 204/3
3,933,601 A * 1/1976 Ishibashi et al. ..... 204/25
4,036,710 A 7/1977 Kardos et al. ..... 204/52
4,750,977 A * 6/1988 Marrese ..... 204/27
4,874,436 A 10/1989 Ogata et al. ..... 148/2

FOREIGN PATENT DOCUMENTS

JP 55-100993 * 8/1980

* cited by examiner

*Primary Examiner*—Edna Wong
(74) *Attorney, Agent, or Firm*—Fleshner & Kim, LLP

(57) ABSTRACT

The present invention relates to a method of forming a conductive layer and an electroplating device, and in particular, to a method of forming a conductive layer that provides an electrically-conductive layer having both characteristics of increased adhesiveness to an electroplated body and increased uniformity. The electroplating apparatus and method can produce supersonic waves for electroplating. Thus, the electroplating device can include a wave generator. The electroplating device can further include a plating bath filled with an electrolyte solution that can propagate super sonic waves, a power supply, a plated body connected electrically to a first terminal of the power supply, and a plating body connected electrically to a second terminal of the power supply where the plating body provides ions the same as dissolved in the electrolyte solution to maintain a desired concentration of dissolved ions.

2 Claims, 3 Drawing Sheets

METHOD OF FORMING A CONDUCTIVE LAYER AND AN ELECTROPLATING APPARATUS THEREOF

BACKGROUND OF THE INVENTION

1. Field of the Invention

The present invention relates to a method of forming an electrically-conductive layer having excellent adhesiveness and uniformity, and an electroplating apparatus.

2. Background of the Related Art

The related art suggests several methods of forming metal-conductive oxide layers. For example, plasma vapor deposition, laser-induced reflow, chemical vapor deposition, electroless deposition and electroplating can create oxidation-proof, wear-proof decoration and wires in semiconductor devices. Of those methods, electroplating and electroless deposition provide high-quality conductive layers possessing excellent deposition characteristics at low process temperatures and low equipment costs.

Electroplating requires the formation of a thick, continuous seed layer on a surface of a plated body. Because the seed layer generates a conductive layer, a low resistance contact must form against the seed layer. For example, a chromium seed layer must be deposited on the stainless steel layer of a plated body in order to electroplate that stainless steel layer with nickel.

To form the seed layer, the solid surface is etched to remove impurities. Next, the plated body is placed in a plating bath containing electrolytes inside a process chamber to prevent formation of natural oxide. As shown in FIG. 1, a metallic seed layer 11 is formed on the surface of a plated body 10 by chemical vapor deposition (CVD) or sputtering, a physical vapor deposition (PVD) method. That seed layer 11 is oxidation-proof and contamination-resistant, and consists of the same or a different substance from the material used for the plated body 10.

Once the seed layer 11 forms, a plating bath is used to continue the electroplating process. That process involves a power supply, an electrolytic solution, a solid metal and a plated body 10. A positive terminal of the power supply connects to the solid metal, while a negative terminal of the power supply connects to the plated body 10. Once those terminal connections have been completed, the solid metal and the plated body 10 are dipped in the electrolyte solution, which contains an ionic species of the solid metal, to initiate the electroplating process.

When the power supply is transited to the 'ON' position, the ionic metal species in the electrolytic solution migrate to the negatively-charged plated body 10, and are deposited on that body to produce a plating layer 12 above the seed layer 11. That deposition process continues until a layer of desired thickness forms. The concentration of cations in the electrolyte solution is maintained as the metal dissolves in the electrolyte solution to compensate for the cations lost in the plating process.

A conductive metal or metal alloy layer as the plating layer 12 results from the electroplating process. The physical or chemical surface treatment of a surface of the plated body 10 before starting the electroplating process removes natural oxides, defects, organic/inorganic foreign contaminants, and impurities on the metal surface of the plated body, so as to form a desired uniform plating layer with strong adhesiveness to the plated body.

That surface treatment is necessary because contaminants and impurities interfere with the nucleation of plating material at the pristine stage. The contaminants and impurities deteriorate the uniformity of the conductive layer and its adhesiveness to the plated body 10. The adhesion between the plated body 10 and the conductive layer 12 is reduced because the space between the deposited metal grains increases because of the poor seed distribution on the plated body 10. As a result, the characteristics and quality of the plating layer 12 deteriorate. In contrast, less space between the grains corresponds with increased adhesion between the plated body 10 and the plating layer 12 and results in a higher quality metal layer with greater conductivity.

FIG. 4 shows a schematic drawing of a scanning electron microscope (SEM) image of a surface of an electroplating layer 12 formed by a related art. A plurality of metal grains 40, 41 grows to form the electroplated layer shown on a seed layer 42. Most of the grains 40, 41 are small in size, and the grain density per unit area is too low to form a highly adhesive, uniform surface. The grains 40, 41 continue to grow to fill in the spaces between the grains and form the plating layer as the whole grains connect to one another. Since the interfaces between the plating layer and the seed layer fail to provide sufficiently dense spaces among the grains, vacant spaces develop under the interfaces. The resulting deterioration of the adhesiveness between the seed layer and the plating layer is disadvantageous to forming a uniform layer.

However, as described above the related art has various disadvantages. The electroplating process of the related art is complicated because a surface of a plated body requires an additional process to conduct chemical surface treatment or to form a seed layer. To form a uniform plating layer, the seed layer requires an expensive metal that is difficult to contaminate. Additional complexities result from the poor adhesiveness between the plated body and the seed layer, as the grains are non-uniform and sparsely formed.

The above description and other related art of the electroplating process are incorporated by reference herein where appropriate for appropriate teachings of additional or alternative details, features and/or technical background.

SUMMARY OF THE INVENTION

Accordingly, the present invention is directed to a method of forming a conductive layer and an electroplating device thereof that substantially obviates one or more limitations and disadvantages of the related art.

An object of the present invention is to provide a method of forming a conductive layer, and an electroplating device using same that provides a uniform conductive layer on a plated body.

Another object of the present invention is to provide a method of forming a conductive layer and an electroplating device using same that provides a conductive layer with excellent adhesion to a plated body.

Another object of the present invention is to provide a method of forming a conductive layer and an electroplating device using the same that uses supersonic waves.

Another object of the present invention is to provide a method of forming a conductive layer and an electroplating apparatus thereof that provides a uniform conductive layer with excellent adhesion to a plated body by adding a supersonic generator to an electroplating unit.

To achieve at least these and other objects and advantages in whole or in parts and in accordance with the purpose of the present invention, as embodied and broadly described, the present invention includes the steps of placing a sonic wave generator in an electrolyte solution, dipping a plated body connected to a negative terminal of a power supply with a switch and a plating body connected to a positive terminal of the power supply in the electrolyte solution where the power supply includes a switch, generating super sonic waves by operating the sonic wave generator, turning on the power supply by operating the switch, turning off the power supply by operating the switch after a predetermined time, and taking the plated body out of the electrolyte solution.

In a further aspect, the present invention includes a first bath filled with a liquid, a second bath filled with an electrolyte solution wherein the second bath is placed in the first bath, a sonic wave generator capable of propagating super sonic waves to the electrolyte solution, a power supply having a first and second terminals and a switch, a plated body connected electrically to the first terminal of the power supply, and a plating body connected electrically to the second terminal of the power supply where the plating body includes a substance that provides ions of the same species dissolved in the electrolyte solution.

In a further aspect, the present invention includes a plating bath filled with an electrolyte solution, a sonic wave generator dipped in the electrolyte solution, a power supply having a first and second terminals, a plated body connected electrically to the first terminal of the power supply, and a plating body connected electrically to the second terminal of the power supply, the plating body comprised of substance which provides ions the same as dissolved in the electrolyte solution.

In yet another aspect, the present invention includes a method for forming a conductive layer, comprising the steps of treating a plated body surface with supersonic waves and forming a plating layer on the treated plated body surface by electrochemistry.

In yet another aspect, the present invention includes an electroplating apparatus, comprising a first chamber containing an electrically conductive liquid, a generator that generates and propagates sonic waves, and a plated body, wherein the sonic waves impinge on the plated body.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The present invention forms a plating layer directly on a surface of a plated body by preferably adding a sonic generator to an electroplating device, and eliminates the need to form an extra seed layer. Supersonic waves generated by the sonic generator in a plating bath remove the natural oxides, impurities and other undesirable particles from the surface of the plated body. Thus, the plating layer is formed directly on the surface of the plated body. According to preferred embodiments of the present invention, the plated body may also be processed in a separate bath to remove natural oxide, contaminants, impurities and the like prior to electroplating in the plating bath.

In the preferred embodiments according to the present invention, a cleaning procedure at an interface between the solid plating body and a liquid electrolyte solution provides a mechanism for removing contaminants and natural oxides remaining on a plated body surface. Preferably, supersonic waves from the sonic generator create vibrations that generate minute bubbles around the interface. Those minute bubbles are produced by gases dissolved in the electrolyte solution. The supersonic wave vibrations cause a repeated contraction and expansion of the bubbles, resulting in a large concentration of energy inside each bubble. The inner pressure and temperature of the bubbles preferably reaches about 100 Kpa and about 1000–3000 K, respectively. The high pressure and temperature of those bubbles can produce a chemical and physical cleaning effect on the interface.

Figure 1:
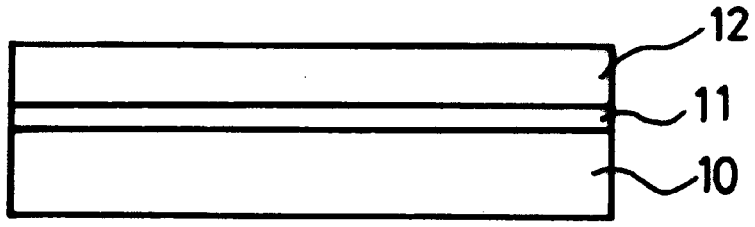
FIG. 1 (PRIOR ART)
FIG. 1 illustrates a cross-sectional view of a metal layer formed by electroplating according to a related art.
Figure 2:
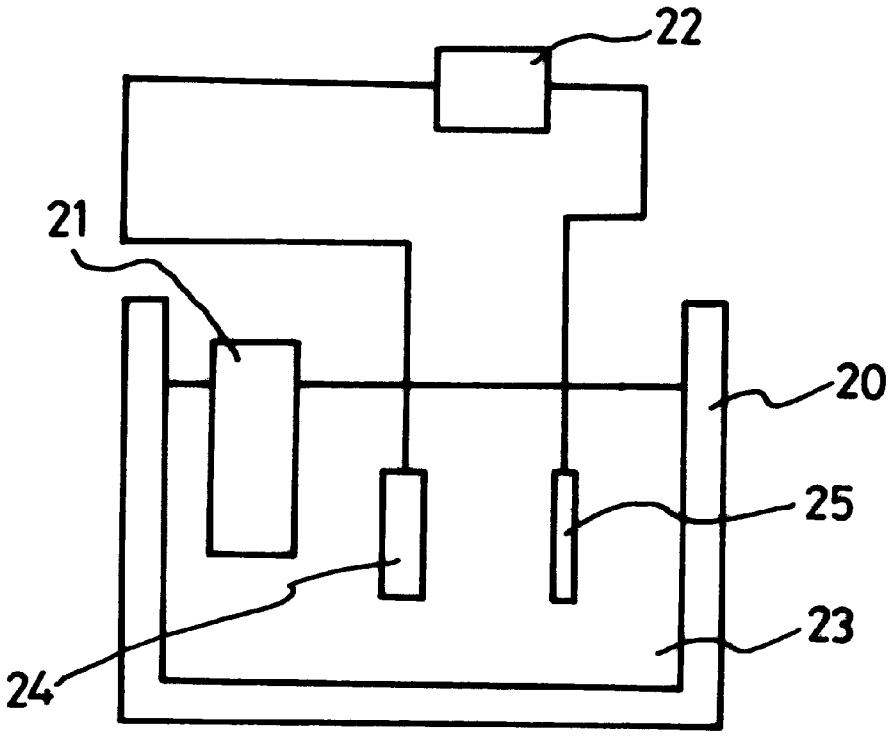
FIG. 2 illustrates a schematic diagram of an apparatus that forms a conductive layer according to a first preferred embodiment of the present invention.

FIG. 2 shows a schematic diagram of an apparatus for forming a conductive layer according to a first preferred embodiment of an electroplating device according to the present invention that uses a solid metal, such as copper (Cu), as the plating material. An electrolyte solution 23 contains a cationic species of the solid metal such as $Cu^{2+}$, a sonic wave generator 21, a plated body 25 and a solid metal bar 24 such as a copper bar, dipped in a plating bath 20. The plated body 25 and the solid metal bar 24 are electrically coupled to the negative and positive terminals, respectively, of a power supply 22 having a switch set up outside the plating bath 25.

The plated body 25 is preferably made of metal, and the electrolyte solution 23 is a mixed solution of acidic and metallic aqueous species such as $CuSO_45H_2O$ at a concentration of about 100 g/l, and $H_2SO_4$ at a concentration of about 50 g/l. The temperature of the plating bath 20 is maintained at approximately 30° C., and the sonic wave generator 21 generates supersonic waves ranging from about 20 KHz to about 60 KHz for the electroplating process, but can be controlled to generate supersonic waves at approximately 45 KHz for the formation of the conductive layer.

After placing the electrolyte solution 23 in the plating bath 20, the plated body 25 coupled to the power supply 22 is dipped in the plating bath 20. The power supply is transited to the 'OFF' position. Then, the sonic wave generator 21 is activated to carry out surface treatment of the plated body 25, thus removing contaminants, oxides and other impurities formed on the plated body surface.

After completing surface treatment of the plated body 25, an electroplating reaction is activated by transiting the switch of the power supply 22 to the 'ON' position. The solid metal (e.g., copper) bar 24 coupled to the positive terminal of the power supply 22 is dipped in the electrolyte solution 23. As the solid metal bar 24 begins to dissolve in the electrolytic solution 23, the cationic species of the solid metal present in the electrolyte solution 23 preferably migrate to the anionic surface of the plated body 25, which is coupled to the negative terminal. Thus, the equilibrium of cationic metal species is maintained. The speed of plating layer formation can be adjusted by controlling the sonic generator 21 to produce proper super sonic waves.

Once a metal-plating layer has been formed on the surface of the plated body 25 to a prescribed or desired thickness, the power supply 22 switch is transited to the 'OFF' position, and the electroplating reaction ceases. Then, the plated body 25 is removed from the plating bath 20 and cleaned.

Figure 3:
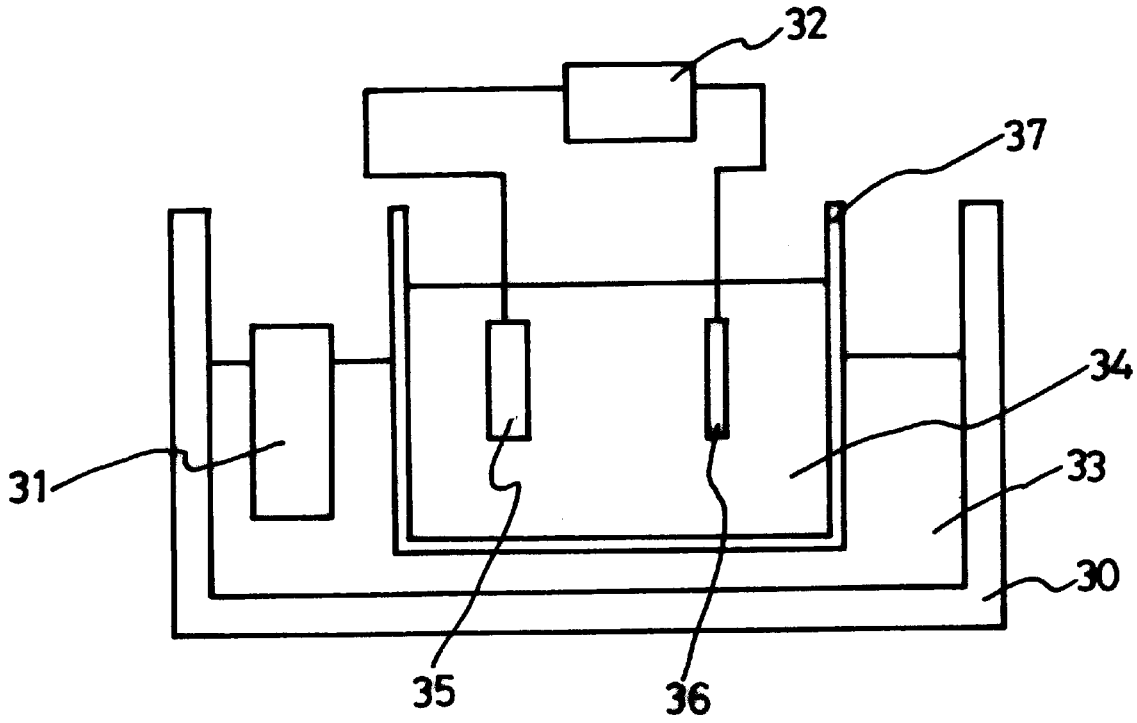
FIG. 3 illustrates a schematic diagram of an apparatus that forms a conductive layer according to a second preferred embodiment of the present invention.
Figure 4:
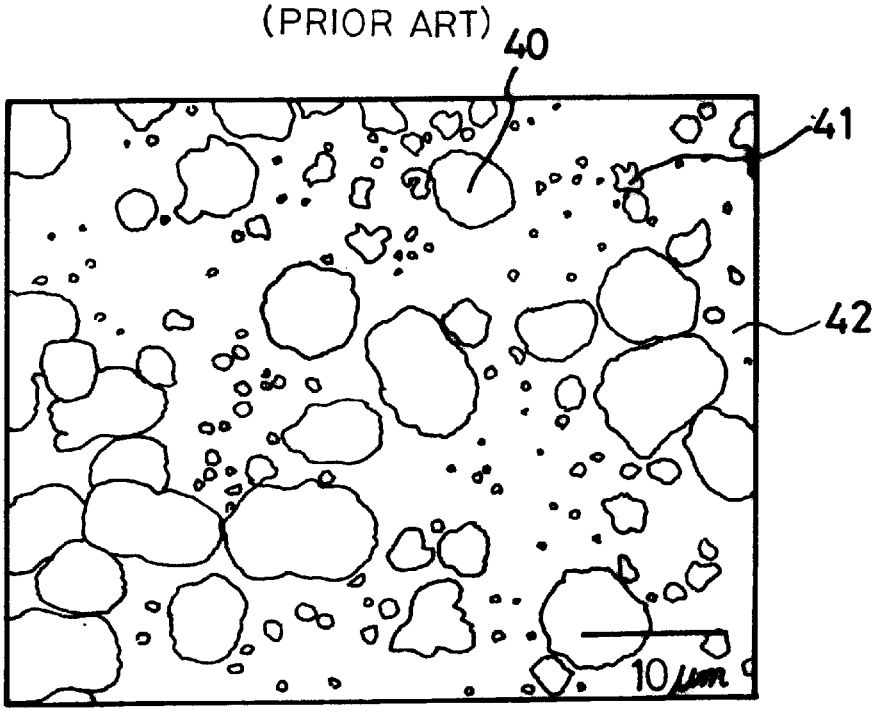
FIG.4 (PRIOR ART)
FIG. 4 is a schematic drawing of a SEM image of a surface of an electroplating layer formed during a related art electroplating process.

FIG. 3 shows a schematic diagram of an apparatus that forms a conductive layer according to a second preferred embodiment of the present invention. In the second preferred embodiment, the plating substance is preferably a metal, such as copper. A supersonic wave bath 30 contains a plating bath 37 as well as a sonic waver generator 31 in a liquid medium 33, for transferring super sonic waves. The plating bath 37 contains an electrolyte solution 34 containing cationic species of the plating substance, such as cupric ions ($Cu^{+2}$), a plated body 36, and a solid metal bar 35 such as copper. The plated body 36 is connected to a negative terminal and the solid metal bar 35 is connected to a positive terminal of a power supply 32. The power supply 32 is located outside of the plating bath 37 and is equipped with a switch. In the present embodiment, the plated body 36 is made of metal and the electrolyte solution 34 is a mixed acid-cationic solution of about 100 g/l-$CuSO_4 5H_2O$ and about 50 g/1-$H_2SO_4$. The internal temperature of the plating bath 37 is maintained at approximately 30° C., and the sonic wave generator 31 is controlled to produce super sonic waves of approximately 45 KHz. However, the sonic wave generator is preferably capable of producing supersonic waves in at least the range of about 20 KHz to about 60 KHz.

Super sonic waves are generated by operating the sonic wave generator 31 while the power supply is in the 'OFF' position. The super sonic waves reach the plating bath 37 through the liquid medium 33, and then touch a surface of the plated body 36. The electroplating process begins with a surface treatment step to remove natural oxide, contaminants and other impurities.

After the magnitude of super sonic waves in the sonic wave generator 31 has been modulated properly, the plated body 36 and the solid metal bar 35 (e.g., copper) are supplied with negative and positive power, respectively, by transiting the switch of the power supply 32 to the 'ON' position. In the second preferred embodiment, cationic ions such as cupric ions in the electrolyte solution 34 are drawn to the anionic surface of the negatively-charged plated body 36, while solid metal (e.g., copper) atoms of the solid metal bar 35 are dissolved in the electrolyte solution 34 to preferably maintain a constant equilibrium of metal cation concentration. The second preferred embodiment uses the super sonic waves to form a conductive metal-plating layer on a surface of a plated body at an increased rate of deposition without additional formation of a seed layer.

A third preferred embodiment according to the present invention (not shown) forms a plating layer on a plated body without a seed layer. After a surface treatment of a plated body has been carried out in a first bath, an electroplating process is performed in a second bath for plating under the condition that there is no chance of forming natural oxide on the plated body surface.

Figure 5:
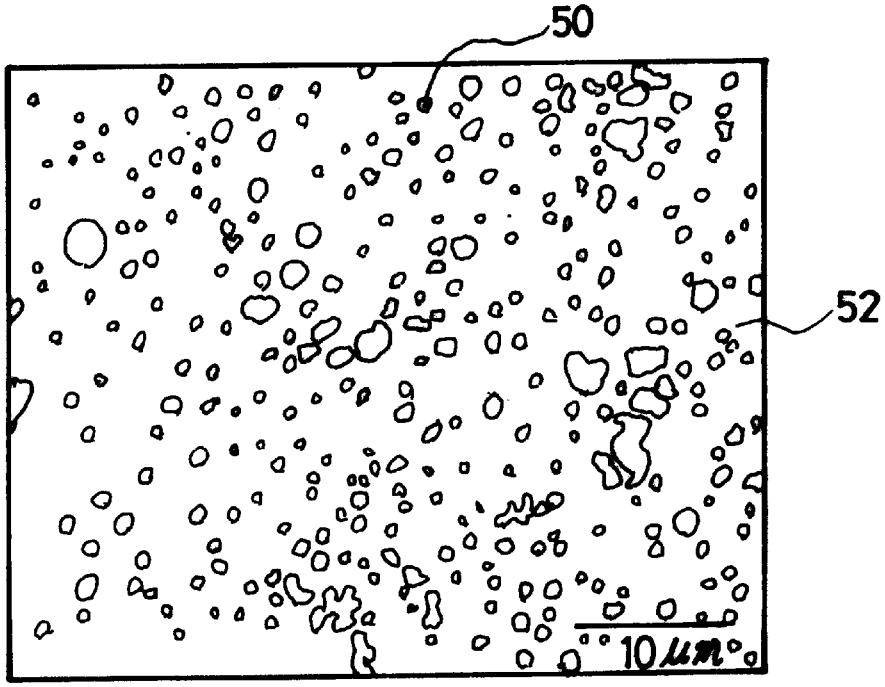
FIG. 5 is a schematic drawing of a SEM image of a surface of an electroplating layer formed during a preferred embodiment of an electroplating process according to the present invention.

FIG. 5 shows a schematic drawing of a scanning electron microscope (SEM) image of a surface of an electroplating layer formed by a preferred embodiment of the present invention during an electroplating process. A plurality of metal grains 50 forms a plating layer by electroplating on a surface of a plated body 52 without a seed layer. Most of the grains 50 are small in size, the distances between the grains are very short, and the number of the grains per unit area is larger than the related art.

Once the electroplating process completes the plating layer, grains continue to grow and fill in the spaces between the grains to provide the plating layer composed of wholly-connected grains. The thickness of the grains results in an interface between the plating layer and the plated layer containing reduced voids or substantially reduced spaces. Thus, a highly uniform layer with improved adhesion characteristics is formed.

Although copper is used as a plating substance in the above-described preferred embodiments of the present invention, the present invention is not intended to be so limited and may be applied to any plating substance. For example, nickel, copper in its ionic species, or alternative electrolyte in solution that results in an initial electroplated layer having increased uniformity and/or density can be used for the plating substance. The present invention can be used any metal capable of being electroplated.

As described above, the preferred embodiments according to the present invention have various advantages. The preferred embodiments provide a uniform, homogeneous plating layer with excellent adhesiveness to a plated body surface by surface treatment with super sonic waves, and without pretreatment such as a seed layer formation on the surface of the electrically conductive plated body, and by electrochemical plating methods.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A method for forming a conductive layer, comprising:

immersing a plated body surface in a first fluid medium disposed within a first chamber;

treating the plated body surface with supersonic waves generated and propagated by a supersonic wave generator immersed in a second fluid medium within a second chamber while a power supply in communication with the plated body surface is OFF, wherein the second fluid medium is in communication with the first fluid medium such that the supersonic waves generated by the supersonic wave generator in the second chamber are communicated to the first chamber; and forming a plating layer on the treated plated body surface by electrochemistry, wherein forming the plating layer by electrochemistry comprises:

immersing the treated plated body surface and a reference metal in the first fluid which comprises an electrolyte solution containing reference metal ions;

coupling the plated body and the reference metal to a cathode and an anode, respectively; and applying negative and positive charges to the cathode and the anode, respectively, by turning the power supply ON.

2. The method of claim 1, wherein the first chamber is immersed in the second fluid medium in the second chamber.

* * * * *